US005117774A

United States Patent [19]

English et al.

[11] Patent Number: 5,117,774

[45] Date of Patent: Jun. 2, 1992

[54] UNDERWATER VIEWING CRAFT

[75] Inventors: Patrick English; Donald Radke; Barry May, all of Cairns, Australia

[73] Assignee: Cofordo 311 Pty Limited, Cairns, Australia

[21] Appl. No.: 689,983

[22] Filed: Apr. 23, 1991

[30] Foreign Application Priority Data

Apr. 26, 1990 [AU] Australia ..... PJ9847

[51] Int. Cl.[5] ..... B63B 35/00

[52] U.S. Cl. ..... 114/66; 114/61

[58] Field of Search ..... 114/66, 333, 61; 441/135

[56] References Cited

U.S. PATENT DOCUMENTS 3,437,067 4/1969 Malin ..... 114/66

4,276,851 7/1981 Coleman ..... 114/66

FOREIGN PATENT DOCUMENTS 277068 8/1988 European Pat. Off. ..... 114/66

214092 9/1987 Japan ..... 114/66

*Primary Examiner*—Jesûs D. Sotelo

*Attorney, Agent, or Firm*—Dressler, Goldsmith, Shore, Sutker & Milnamow, Ltd.

[57] ABSTRACT

A water craft which comprises a motor propelled floating portion which has two spaced-apart hulls which are connected by an elevated bridge. The water craft further comprises a submersible cabin which is arranged to be raised and lowered with respect to the floating portion of the craft, the cabin providing accommodation for underwater observers. The cabin is connected to each hull by fore and aft pivotable arms and is movable between a first position above the waterline of the floating portion of the craft to a second, submerged, position. The cabin is accessed from the floating portion of the craft when the cabin is in the first position and, in order to provide for fail-safe operation, the cabin is ballasted for positive buoyancy when it is submerged. The cabin incorporates a tower which is dimensioned to project above the waterline at all times, including when the cabin is sumberged to the maximum extent permitted by the pivotable arms.

9 Claims, 2 Drawing Sheets

UNDERWATER VIEWING CRAFT

FIELD OF THE INVENTION

This invention relates to a water craft which incorporates a submersible cabin. The cabin, which is arranged to be raised and lowered with respect to a floating portion of the craft, provides accommodation for underwater observers and is accessed from the floating portion of the craft.

BACKGROUND OF THE INVENTION

Various types of underwater viewing craft have been used or proposed for recreational purposes. Australian patent no. 554,889 discloses a craft which has a lower underwater observation compartment which remains submerged when the craft is ballasted for normal operation. The craft suffers the disadvantage that it has a large displacement and, as a consequence, cannot travel at high speeds. This means that the craft cannot conveniently travel a large distance to a location where underwater observation is desired.

Australian patent no. 569,919 discloses a submersible craft which includes three hulls which are interconnected by lever systems. One of the hulls is submersible with respect to the other two, with articulation of the lever systems, when the craft has reached a location at which an underwater observation is desired to be made. Thus, displacement related problems do not arise. However, a difficulty with the craft which is disclosed in patent no. 569,919 is that passengers are at all time accommodated in the confined space of the submersible hull. There is no access between the main, submersible, hull and the interconnected secondary hulls and it is thought that this could give rise to problems if the craft were required to travel long distances.

The present invention seeks to avoid the above discussed problems by providing a craft having a floating portion which is arranged to carry passengers in the manner of conventional water craft and which also carries a cabin which can be moved into a submerged position as and when required.

SUMMARY OF THE INVENTION

Broadly defined, the present invention provides a water craft having a floating portion which is arranged to carry passengers and a cabin carried by the floating portion. The cabin is moveable between a first position adjacent or above the waterline of the floating portion and a second position at which it is at least partially submerged. Means are provided on the floating portion for supporting the cabin and for driving the cabin downwardly and upwardly between the first and second positions, and means associated with the floating portion are provided for propelling the craft. Also, provision is made for channelling air into the cabin when it is in the submerged condition. The cabin is constructed to provide for underwater observation, is arranged to accommodate passengers and is provided with a hatch which permits passenger movement between the cabin and the floating portion when the cabin is in the first position.

PREFERRED FEATURES OF THE INVENTION

The cabin is preferably provided with a tower through which air is channelled and which has an upper end which projects above the waterline at all times, including when the cabin is submerged to its maximum extent.

The cabin may be ballasted for neutral or negative buoyancy, so that submersion of the cabin is assisted. However, the cabin is preferably constructed and ballasted to maintain a slight positive buoyancy so that it will rise from a submerged condition if the means for driving the cabin between the first and second positions should fail or become inoperable.

The cabin may be configured in various ways, for example as a pod which is projected axially downwardly from within a sealed cavity within the floating portion of the craft. Also, the floating portion may be constructed in various ways, as a mono-hull structure or as a multi-hull structure. However, the cabin is preferably constructed as a capsule which is carried between spaced-apart hulls of the floating portion of the craft. Thus, the floating portion of the craft is preferably constructed in the manner of a catamaran type vessel and the two hull portions of the vessel are preferably linked by a deck and/or a bridge.

In use of the craft, passengers and crew would normally be accommodated on the floating portion when the craft is moving from the shore to a site at which underwater observations are required to be made. Then, having reached the observation region, intending observers are loaded into the cabin and the cabin is submerged to an extent required. The complete craft may be maintained in a stationary condition when the cabin is submerged or the craft may be propelled at slow speed so that underwater observations may be made over a large area.

The cabin may be provided with two or more towers of the type above mentioned, and facilities may be provided to enable the or each of the towers to be used as escape hatches when the cabin is in a submerged condition.

The invention will be more fully understood from the following description of a preferred embodiment of the underwater viewing craft which is illustrated, somewhat schematically, in the accompanying drawings.

DETAILED DESCRIPTION OF THE DRAWINGS

Figure 1:
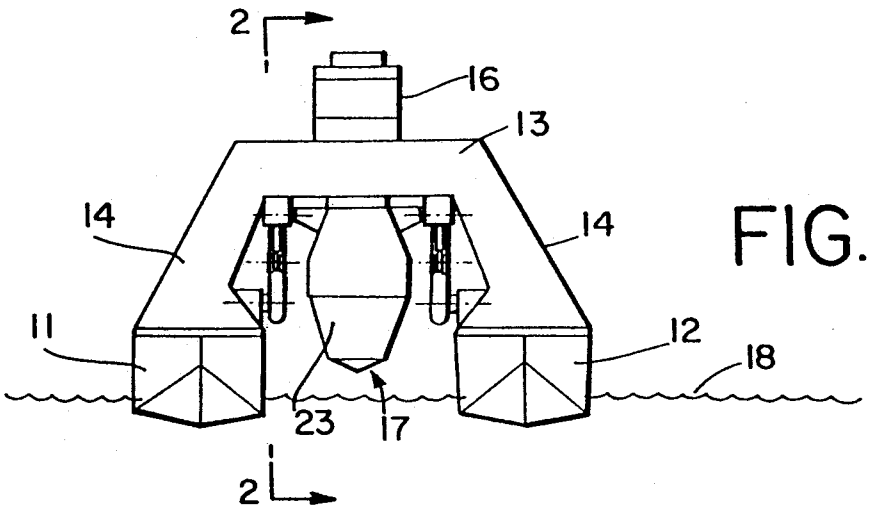
FIG. 1 shows an end elevation view of the stem end of the craft, with a cabin portion of the craft shown in an elevated position.

As illustrated, the underwater viewing craft comprises a floating portion 10 in the form of a catamaran having hull portions 11 and 12. The hull portions are interconnected by an elevated deck area 13 which is supported above each of the hull portions by fore and aft superstructure members 14 and 15, and a control bridge 16 is located at the forward end of the deck area. The hull portions 11 and 12 house propulsion units 29 for the craft, together with such ancillary plant as would normally be included in a vessel which is registered for commercial recreational purposes.

A cabin 17 is carried by the floating portion 10 of the craft and, when not being used for underwater observation, the cabin 17 is supported at a level slightly above the normal waterline 18 of the craft. This is shown in FIG. 1 of the drawings.

Figure 4:
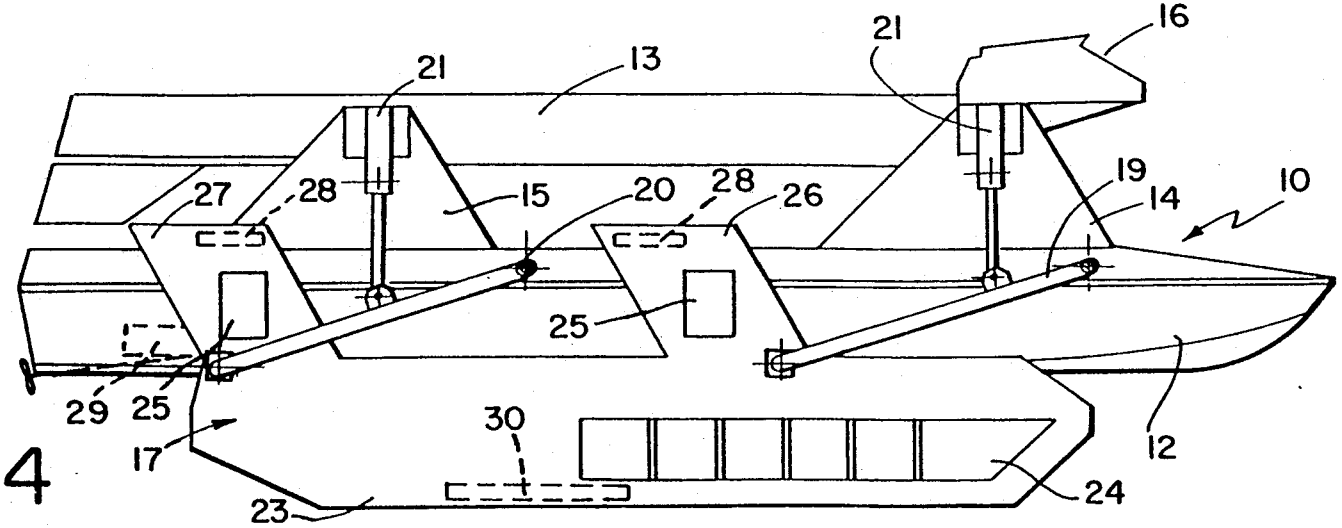
FIG. 4 shows a side elevation view of the craft when viewed in the direction of section plane 4—4 shown in FIG. 3.

The cabin 17 is connected to each of the hull portions 11 and 12 by fore and aft pivotable arms 19 and 20. Hydraulic rams 21 are mounted at the upper ends to the superstructure members 14 and 15, and the rams are pivotably connected at their lower ends to the arms 19 and 20. When actuated by the admission of hydraulic fluid, the rams 21 drive the arms 19 and 20 downwardly from the position shown in FIG. 2 to that which is shown in FIG. 4. This causes a lower portion 23 of the cabin 17 to be submerged relative to the floating portion of the craft.

The lower portion 23 of the cabin 17 is constructed as a capsule which may be completely submerged and it is configured internally in a manner so as to accommodate persons who wish to engage in underwater observation. Seating (not shown) is provided within the cabin and windows 24 are located within lower side walls of the cabin. The windows 24 are sealed within surrounding frames so as to withstand water entry, and the windows incline downwardly and inwardly to facilitate viewing of the sea bed.

Hatches 25 are located in side walls of two towers 26 and 27 which extend upwardly from the lower portion of the cabin. The hatches provide access to the interior of the cabin 17 and they are normally aligned with the deck area 13 of the floating portion 10 of the craft when the cabin is in the raised position shown in FIGS. 1 and 2.

Each of the cabin towers 26 and 27 has an upper end which locates above the waterline 18, even when the cabin is submerged to the maximum possible extent. The towers are open to the atmosphere and they form funnels or channels by which fresh air enters (and stale air leaves) the interior of the cabin. Also, the towers 26 and 27 may be used as escape hatches in the event that anything should go amiss in the cabin when it is submerged.

Fans 28 may be located in one or the other or both of the towers 26 and 27 or within the lower portion 23 of the cabin for inducing airflow through the cabin 17.

Figure 2:
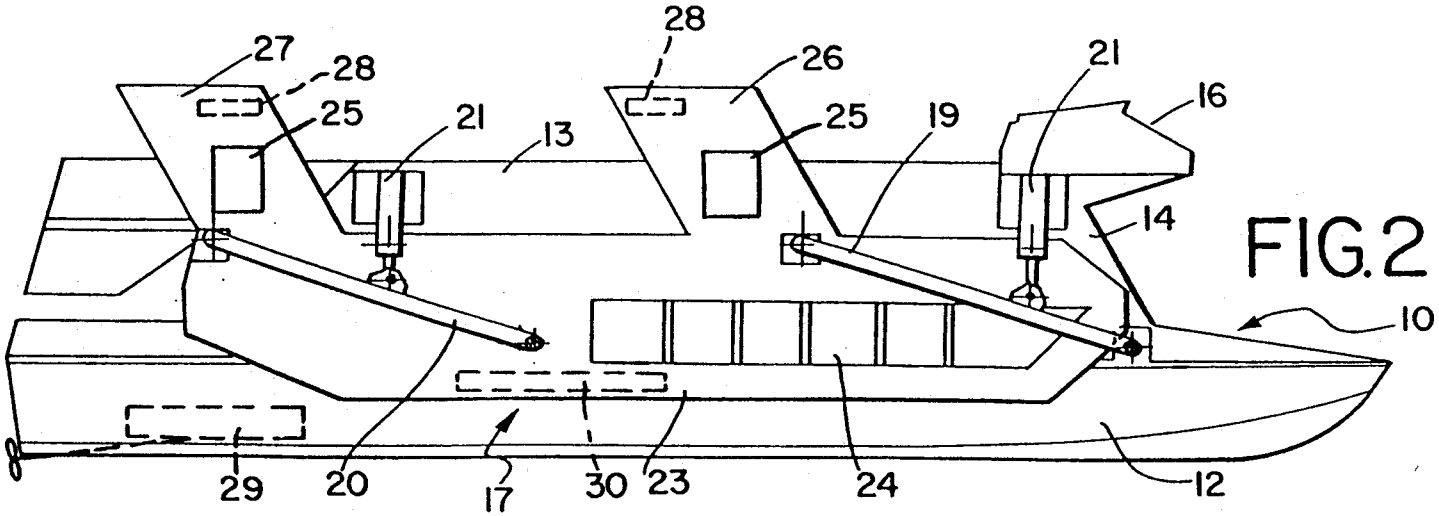
FIG. 2 shows a side elevation view of the craft as seen in the direction of section plane 2—2 in FIG. 1.
Figure 3:
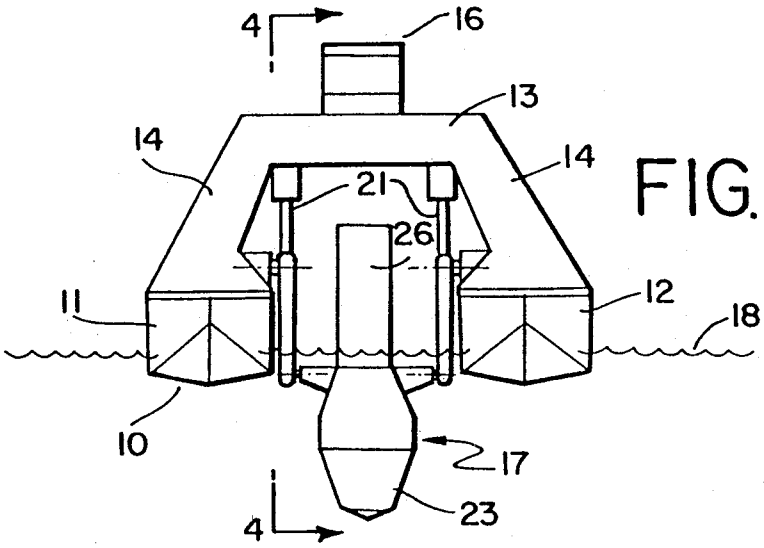
FIG. 3 shows a view of the craft which is similar to that shown in FIG. 1 but with the cabin portion illustrated in a submerged condition.

When travelling from a shore base to a site at which underwater observations are to be made, the cabin 17 is carried by the floating portion 10 of the craft in the position shown in FIGS. 1 and 2. That is, in the raised condition between the two hulls 11 and 12 of the floating portion 10 of the craft. With the cabin so positioned above the normal waterline 18, the craft may move at high speed from the shore base to the observation site, deriving its motive power from the propulsion units 29 in the hull portions 11 and 12. The passengers and crew will be carried on the deck area 13 and/or within the bridge 16 during such movement of the craft.

Having reached a desired observation site, intending observers will then move from the deck area 13 of the craft and into the cabin by way of one or other of the hatches 25. Then, when the passengers are housed within the cabin, the cabin is lowered into the water until it reaches a desired depth to permit unimpeded underwater observation of submarine animal or plant life. As above mentioned, fresh air is channelled into the cabin by way of one or other of the towers 26 and 27.

When the lower portion 23 of the cabin is fully submerged, the towers 26 and 27 have their upper ends located above the waterline to permit movement of air into and through the craft, and to permit passengers to escape upwardly from the craft and out through the towers should a need exist to do so.

In order to counter the buoyancy forces exerted by the cabin 17 when it is lowered into the water, lead ballast 30 is located in the floor and/or walls of the cabin 17. Additionally, water ballast may be admitted to ballast tanks (not shown) within the cabin 17 for trimming the buoyancy of the cabin. Ballasting is preferably provided to an extent sufficient to provide for neutral buoyancy or slight positive buoyancy of the cabin 17, so that the cabin will be prevented from sinking in the event of any failure of hydraulic systems associated with the rams 21.

I claim:

1. A water craft comprising a floating portion which is arranged to carry passengers, a cabin carried by the floating portion and movable between a first position adjacent to above the waterline of the floating portion and a second portion at which it is at least partially submerged, means on the floating portion for supporting the cabin and for driving the cabin downwardly and upwardly between the first and second positions, means associated with the floating portion of the craft for propelling the craft, at least one tower formed as an upward extension of the cabin and dimensioned to project above the waterline at all times, including when the cabin is submerged to the maximum extent permitted by the supporting means, and means for channelling air into the cabin when it is in the submerged condition, the cabin being constructed to provide for underwater observation, being arranged to accommodate passengers and being provided with at least one hatch which permits passenger movement between the cabin and the floating portion of the craft when the cabin is in the first position.

2. The water craft as claimed in claim 1 wherein the or each tower provides a passage through which air is channelled into and from the cabin.

3. The water craft as claimed in claim 1 wherein the hatch is located in the or each tower.

4. The water craft as claimed in claim 1 wherein the cabin is ballasted for a slight positive buoyancy when submerged.

5. The water craft as claimed in claim 1 wherein the floating portion of the craft comprises a multi-hull structure.

6. The water craft as claimed in claim 1 wherein the floating portion of the craft comprises two spaced-apart hulls which are connected by an elevated bridge.

7. The water craft as claimed in claim 6 wherein a lower portion of the cabin is formed as a capsule which is carried between the hulls of the floating portion of the craft.

8. The water craft as claimed in claim 6 wherein the cabin is connected to each hull by fore and aft pivotable arms and wherein actuators are connected to the arms for applying pivotal driving movement to the arms.

9. The water craft as claimed in claim 6 wherein the cabin is provided in side walls thereof with windows which incline downwardly and inwardly.

* * * * *